US006447064B1

(12) United States Patent
Mundy et al.

(10) Patent No.: US 6,447,064 B1
(45) Date of Patent: Sep. 10, 2002

(54) WHEELCHAIR WITH TILTABLE SEAT

(75) Inventors: Phil Mundy; Matt Delorme; Nancy Balcom, all of Vancouver (CA)

(73) Assignee: PDG, Inc., Vancouver (CA)

( * ) Notice: Subject to any disclaimer, the term of this patent is extended or adjusted under 35 U.S.C. 154(b) by 31 days.

(21) Appl. No.: 09/597,858

(22) Filed: Jun. 20, 2000

(51) Int. Cl.[7] ..... A47C 3/00
(52) U.S. Cl. ..... 297/313; 297/326; 297/327
(58) Field of Search ..... 297/313, 326, 297/327, 328

(56) References Cited

U.S. PATENT DOCUMENTS

| | | | | | |
|---|---|---|---|---|---|
| 2,753,919 | A | * | 7/1956 | Sill | 297/327 X |
| 3,627,252 | A | * | 12/1971 | Yamaguchi | 297/328 X |
| 3,810,674 | A | * | 5/1974 | Svensson | 297/326 |
| 4,076,308 | A | * | 2/1978 | Slabon et al. | 297/313 |
| 4,632,455 | A | * | 12/1986 | Schiller et al. | 297/326 |
| 4,832,402 | A | * | 5/1989 | Zund | 297/302.7 |
| 4,889,384 | A | * | 12/1989 | Sulzer | 297/303.4 |
| 4,893,827 | A | * | 1/1990 | Gay et al. | 297/327 X |
| 5,215,352 | A | * | 6/1993 | Yeh et al. | 297/328 |
| 5,294,141 | A | * | 3/1994 | Mentessi et al. | 280/250.1 |
| 5,383,709 | A | * | 1/1995 | Chaney et al. | 297/302.2 |
| 5,738,409 | A | * | 4/1998 | Bursik | 297/265.1 |
| 6,276,704 | B1 | * | 8/2001 | Suiter | 280/250.1 |

OTHER PUBLICATIONS

"Concept 45", 1999, Invacare flier, www.invacare.com.
"Invacare A–T", 2000, Invacare flier, www.invacare.com.
"Invacare Solara", 2000, Invacare flier, www.invacare.com.
"Quickie T45", 1996, Quickie Design Inc., www.quickiedesigns.com.

* cited by examiner

*Primary Examiner*—Carl D. Friedman
*Assistant Examiner*—Brian E. Glessner
(74) *Attorney, Agent, or Firm*—Michael A. Glenn

(57) ABSTRACT

A wheelchair with a tiltable seat locates the tilt fulcrum between 3 and 7 inches from the front edge of the seat pan and between 1 and 4 inches below the surface of the seat pan. This minimizes the elevation of the rider's knees when in a tilted position, and allows for more stability and a shorter wheel base. Manual self-tilting is facilitated by a gas strut arrangement disposed on brackets below the seat pan, and operated by a rider-controlled valve.

10 Claims, 5 Drawing Sheets

WHEELCHAIR WITH TILTABLE SEAT

TECHNICAL FIELD OF THE INVENTION

This invention relates to a wheelchair, and in particular a wheelchair having a tiltable seat.

BACKGROUND OF THE INVENTION

There exist several commercially available manually operated wheelchairs for individuals who benefit from sifting in a tilted position. When applied to a wheelchair, the term tilt generally refers to the seat surface having a capability of being put into a tilted position, thereby redistributing pressure experienced by the user's skin surfaces. However, in all known existing embodiments, tilt is accomplished via a mechanism that has limitations.

The tilting operation in prior art manually operated wheelchairs is usually performed by a wheelchair attendant rather than by the rider himself or herself, and the tilt lock and control mechanism is usually mounted near the rear handgrips. Thus an attendant is required to tilt the seat.

Typically, the seat is made to tilt about a line in the plane of the seat, several inches forward of the intersection of the seat support surface and back support surface. This location is used because it roughly coincides with the vertical center of mass of an individual sitting in the wheelchair (when not tilted). In this case, the seat and back rotate about a point along the vertical center of mass, with rotation about a fulcrum located at the seat surface. The result of tilting the seat and back about this point is that relatively little effort is required to rotate the individual as rotation is about that is initially near the rider's center of mass. However, this arrangement places certain limitations on the functionality of the wheelchair. The rider's knees move upward as the seat is tilted. In most instances the knees move at least 5 inches upward as the seat is tilted to 45 degrees, thereby preventing the person from fitting their legs under a table or desk while in the tilted position.

An additional disadvantage of that approach is that as the rider is tilted back, the center of gravity of the rider shifts rearwardly. As the center of gravity approaches and traverses the rear wheel axis, the rider is at risk of falling backwards. The approach used in the prior art to avoid this is to place the rear wheels of the wheelchair relatively further to the rear of the frame than is the case for non-tilting wheelchairs. But as a result, the wheelchair is longer and is therefore less adapted to maneuver in restricted environments, such as a home or an office. This wheel location also prevents the user from accessing the rear wheels for use in manually propelling the wheelchair.

In another prior art approach, the seat and back still tilt about a point roughly located at the center of mass of the seated individual, but tilting is through an offset cam or through the use of glides positioned underneath the seat. While the effort required to tilt the seated individual may be somewhat less in this assembly, the user's knees still move upward as the seat tilts, preventing access under a table or desk, as described previously.

It is an object of the present invention to provide a wheelchair, which is specifically designed so that the users knees move upwardly only slightly as the chair is tilted, therefore allowing for unobstructed use of a desk or table while in a tilted position.

It is a further object of this invention to provide a wheelchair specifically designed so that the centre of gravity moves rearward only minimally as the wheelchair is tilted.

As the wheelchair tilts, the centre of gravity moves primarily in a downward direction, therefore facilitating a wheelchair where the rear wheels can be positioned more forwardly than in prior art tilting wheelchairs. This feature permits easy access to the rear wheels for users who wish to have hand access to the rear wheels.

It is a further object of this invention to provide a wheelchair specifically designed so that the user can activate the tilting mechanism without assistance, allowing the individual to change position independently, either increasing or decreasing the amount of tilt. The change in position should be achievable without assistance from another person or assistance from a remote power source such as an electric motor.

SUMMARY OF THE INVENTION

The inventors have determined that by altering the location of the tilt fulcrum, many of the objects of the invention can be achieved.

The invention comprises locating the fulcrum between 3" and 7" from the front edge of the seat, the preferred location being about 5" rearward of the front edge of the seat surface. Tilting about a line located too close to the front edge of the seat will result in some wheelchair configurations being less than ideal. In particular, if the seat surface is rotated about a line that is less than 3" from the front edge of the seat, seat depths longer than 17" will result in the rear edge of the seat getting too close to the ground when the seat is tilted at 45 degrees. This problem is especially apparent when the height of the level seat surface is less than 15" above the floor. Tilting from a point too far rearward from the front of the seat will result in the user's knees moving too far upward as the chair tilts, making tables and desks inaccessible when the chair is in the tilt position.

Having regard to the vertical plane, the invention, locates the tilt fulcrum between 1" and 4" below the front edge of the seat, measured when the seat is in a level position. When the seat is tilted about a fulcrum located 4" below the seat surface, the change in knee elevation is minimized as the seat is tilted.

When the seat tilts about the fulcrum location according to the present invention, the centre of mass of the rider moves downward as the seat is tilted. This in turn reduces the need to place the rear wheels too far back and improves overall stability of the wheelchair. Since the rear wheels can be positioned more forwardly, this wheelchair will be easier for the user to propel because he/she will be able to reach the rear wheels.

However, since the fulcrum according to the invention is forward of the rider's' centre of mass, additional uplift force is preferably provided to assist the rider in bringing the seat out of tilt. The invention uses a gas strut to accomplish this. As the weight of potential riders varies widely, the uplift force should also be adjustable so as to balance the load applied by the user sitting and tilting on the seat. Such adjustability is achieved by accommodating different positions of the gas strut so that it has more or less mechanical advantage, depending on the weight of the individual using the wheelchair. If the user is heavy, the gas strut is positioned so that it pushes upwardly at a point far from the fulcrum, thereby maximizing its' mechanical advantage. If the user is lighter, the gas strut may be positioned so that it pushes upwardly at a point close to the fulcrum, minimizing the struts' mechanical advantage. Adjustable mounting brackets are provided with a plurality of holes allowing securement of the gas strut in the most advantageous position.

It will be appreciated that the inventors have achieved an adjustable uplift force that allows the same gas strut to be used in tilt chairs carrying a wide range of riders of different weight. Since the position of the gas strut can be changed to increase or decrease the effective mechanical advantage, the strut can be positioned in such a way that it nearly balances the weight of the user thereby allowing most riders to independently tilt the seat.

Other features of the invention will be appreciated by reference to the detailed description of the preferred embodiment and to the claims.

BRIEF DESCRIPTION OF THE DRAWINGS

The preferred embodiment of the invention will be described by reference to the drawings thereof in which.

DETAILED DESCRIPTION OF THE PREFERRED EMBODIMENT OF THE INVENTION

Figure 1:
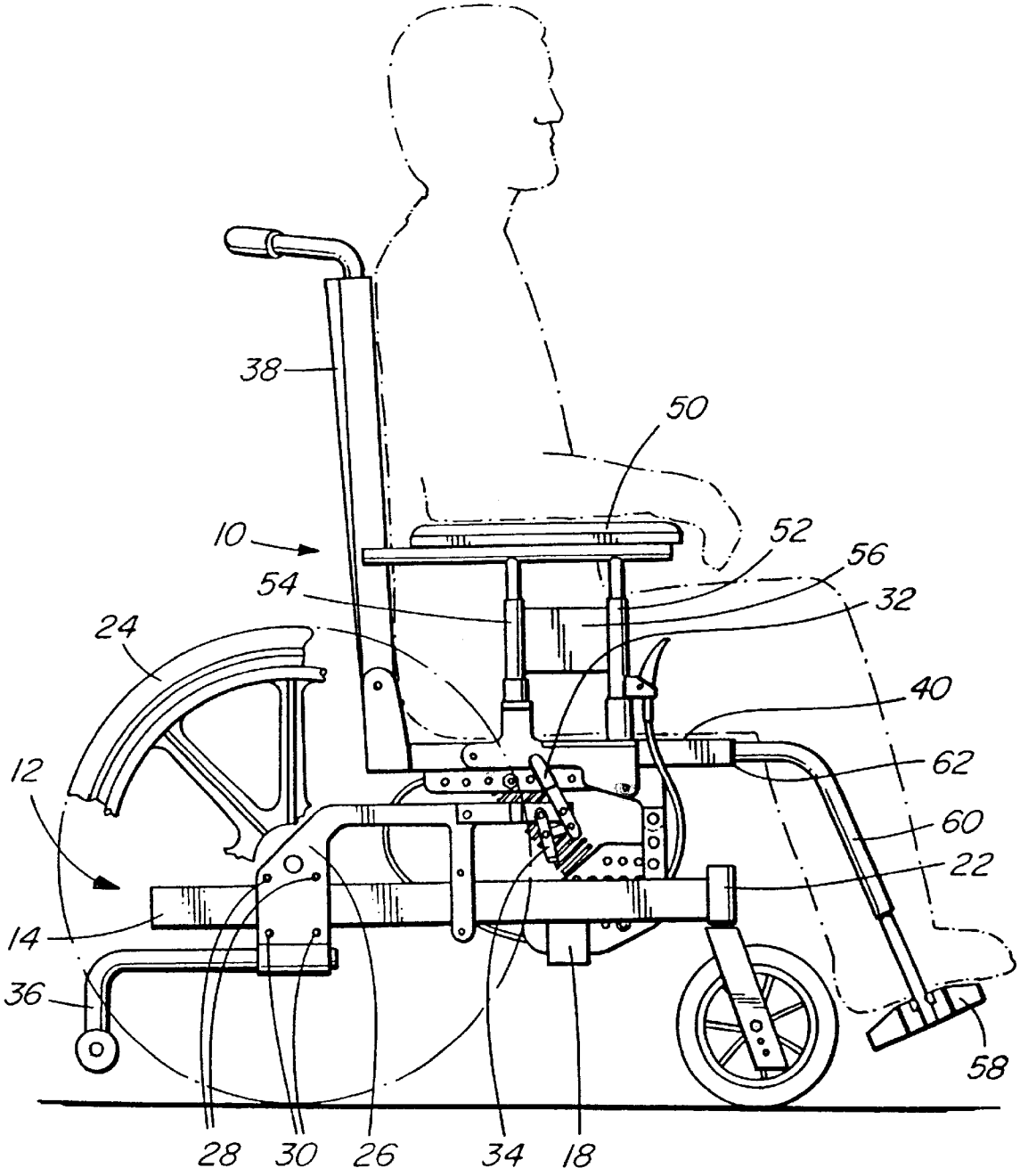
FIG. 1 is a side elevation of a wheelchair according to the preferred embodiment of the invention, with the seat is a normal position.
Figure 2:
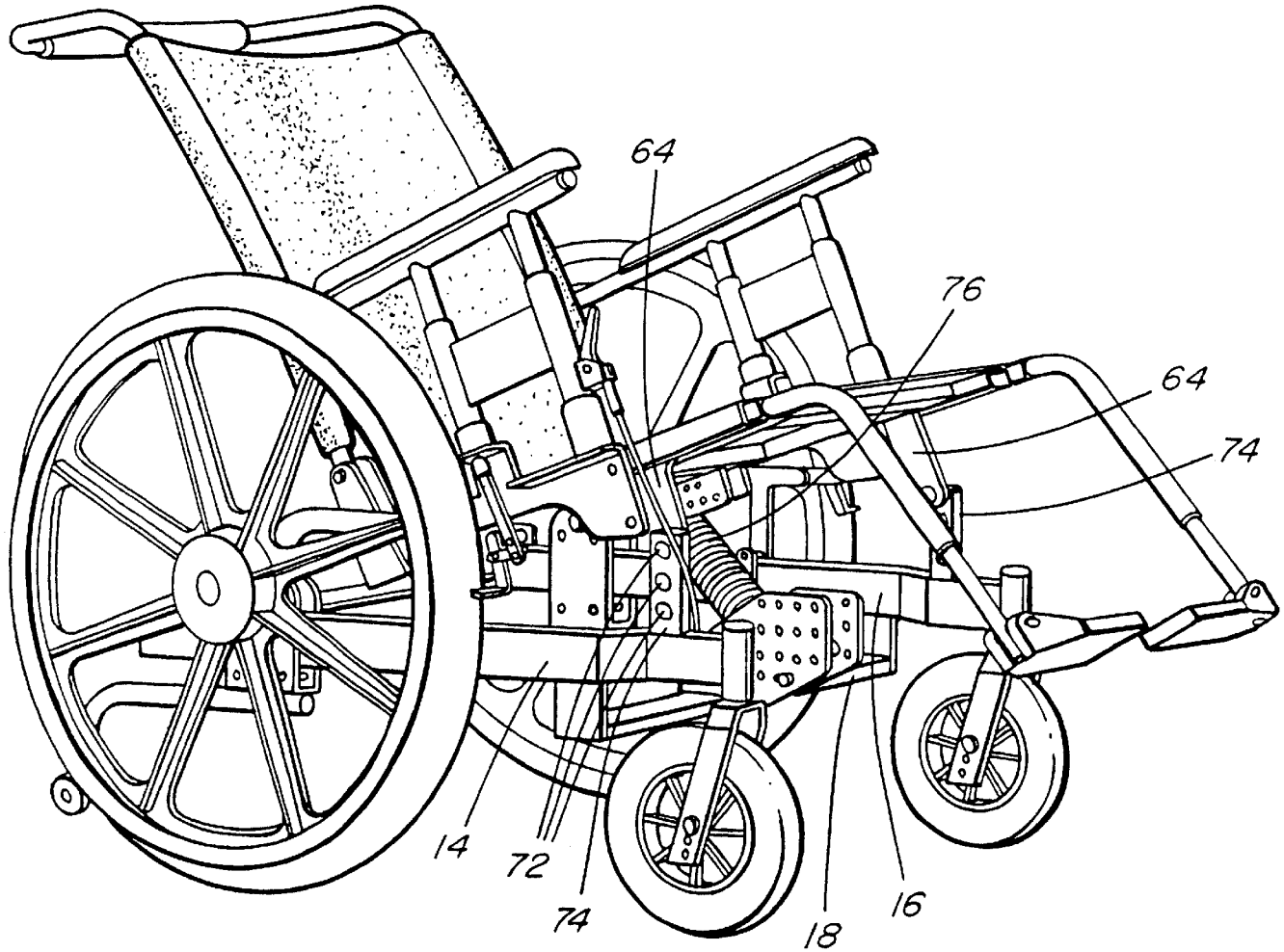
FIG. 2 is a perspective view from the front and side of the wheelchair.

Referring to FIGS. 1 and 2, a seat assembly, generally indicated by the numeral 10, is supported on a frame assembly, generally indicated by the numeral 12.

Frame assembly 12 includes parallel side frame members 14, 16, and front and two rear cross bars (only one of which is visible and is indicated by the numeral 18), extending between side frame members 14 and 16.

Each side of the frame assembly further includes a caster mount 22 at the forward end of the side frame member, a rear wheel 24, and a wheel mounting frame 26. The wheel mounting frame 26 consists of two facing plates that are clamped about side frame member 14 and bolted into place as at 28, 30.

A brake lever 32 is used to operate a brake 34 that abuts against the rear wheel 24. An anti-tipper 36 extends rearward and downward from the wheel mounting frame 26.

Figure 4:
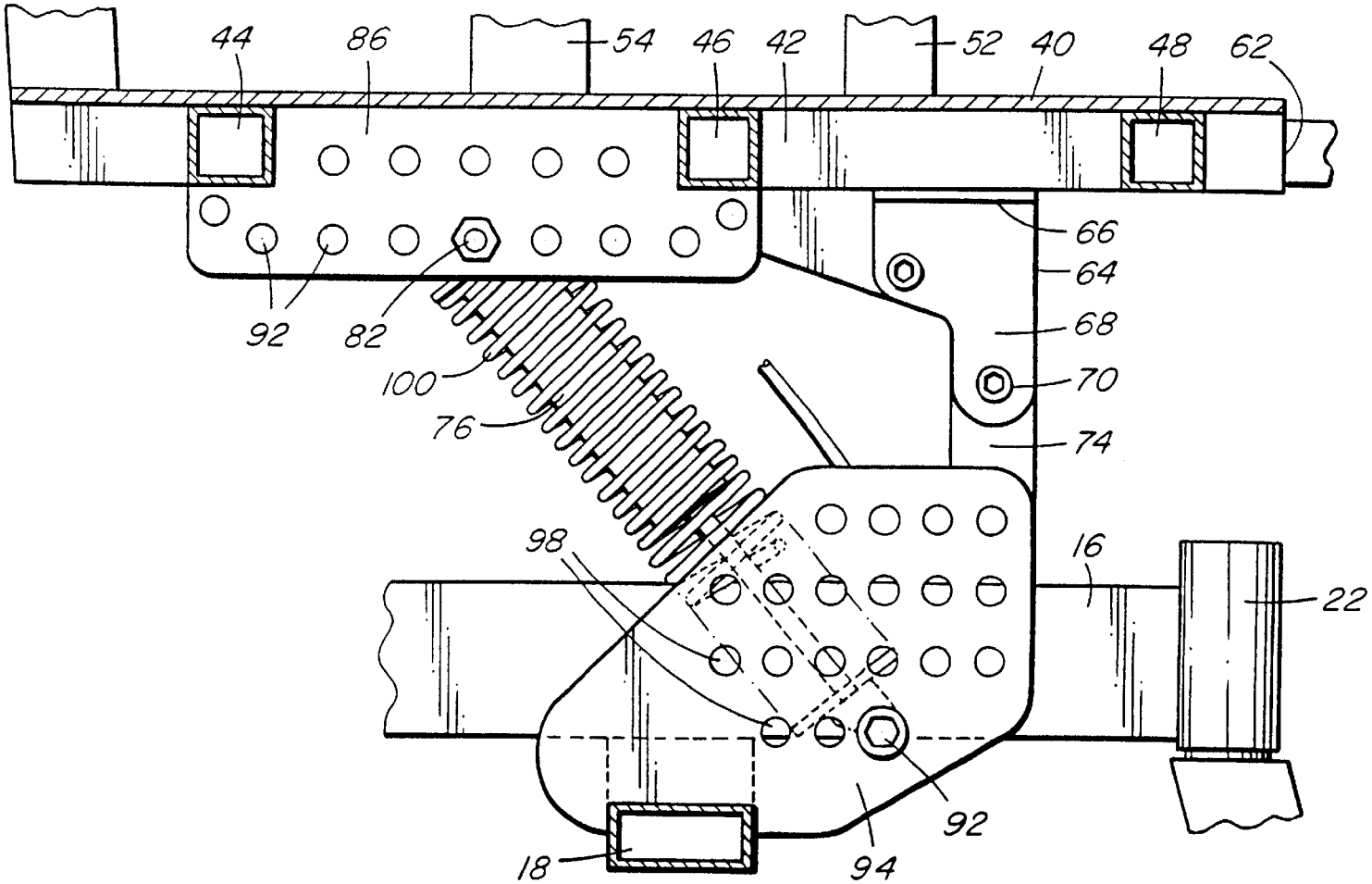
FIG. 4 is a side elevation of the suspension system and mounts, with the seat in a normal position; and, FIG. 5 is a side elevation of the suspension system and mounts, with the seat in a tilted position.

Seat assembly 10 includes seat back 38 and a seat pan 40. As is best seen in FIGS. 2 and 4, seat pan 40 is mounted on a frame comprising box frame members 42 extending from front to back on each side of the seat pan 40, and seat cross bars 44, 46, 48.

Each side of the seat assembly further includes an arm rest 50, arm rest support posts 52, 54, an arm rest support frame 56, a foot rest 58 and a foot rest support 60 that extends forward and downward from the front edge 62 of seat pan 40.

Seat assembly 10 is supported on the frame assembly 12 as follows. Referring to FIG. 4, each side of the side pan 40 includes an L-shaped bracket 64 the horizontal web 66 of which is welded to the underside of a box frame member 42. The vertical web 68 includes a hole for receiving a shoulder bolt 70 that also passes through one of several holes 72 in a post 74 that extends upward from side member 14 and 16. The shoulder bolt 70 provides a pivoting connection between the seat assembly 10 and the frame assembly 12 about one of holes 72 and provides the principal means of supporting the weight of the seat assembly 10 on the frame assembly 12. Additional support is provided by the gas strut 76. Gas strut 76 and its associated assembly will be described in more detail below.

The shoulder bolt 70 and its pivoting connection about hole 72 provides the tilt fulcrum for the seat assembly 10. Bracket 64 and post 74 are therefore disposed so as to locate the pivoting connection between 3" and 7" rearward from the front edge 62 of seat pan 40 when the seat pan is horizontal as shown in FIGS. 1 and 4. The preferred distance is 5" from the front edge 62.

The downward extent of vertical web 68 and its associated hole 72, the height of post 74 and/or the height of holes 72 are selected such that the pivoting connection (i.e. the tilt fulcrum) is between 1" and 6" below the top surface of the seat pan 40. The preferred difference in height is 4".

Figure 3:
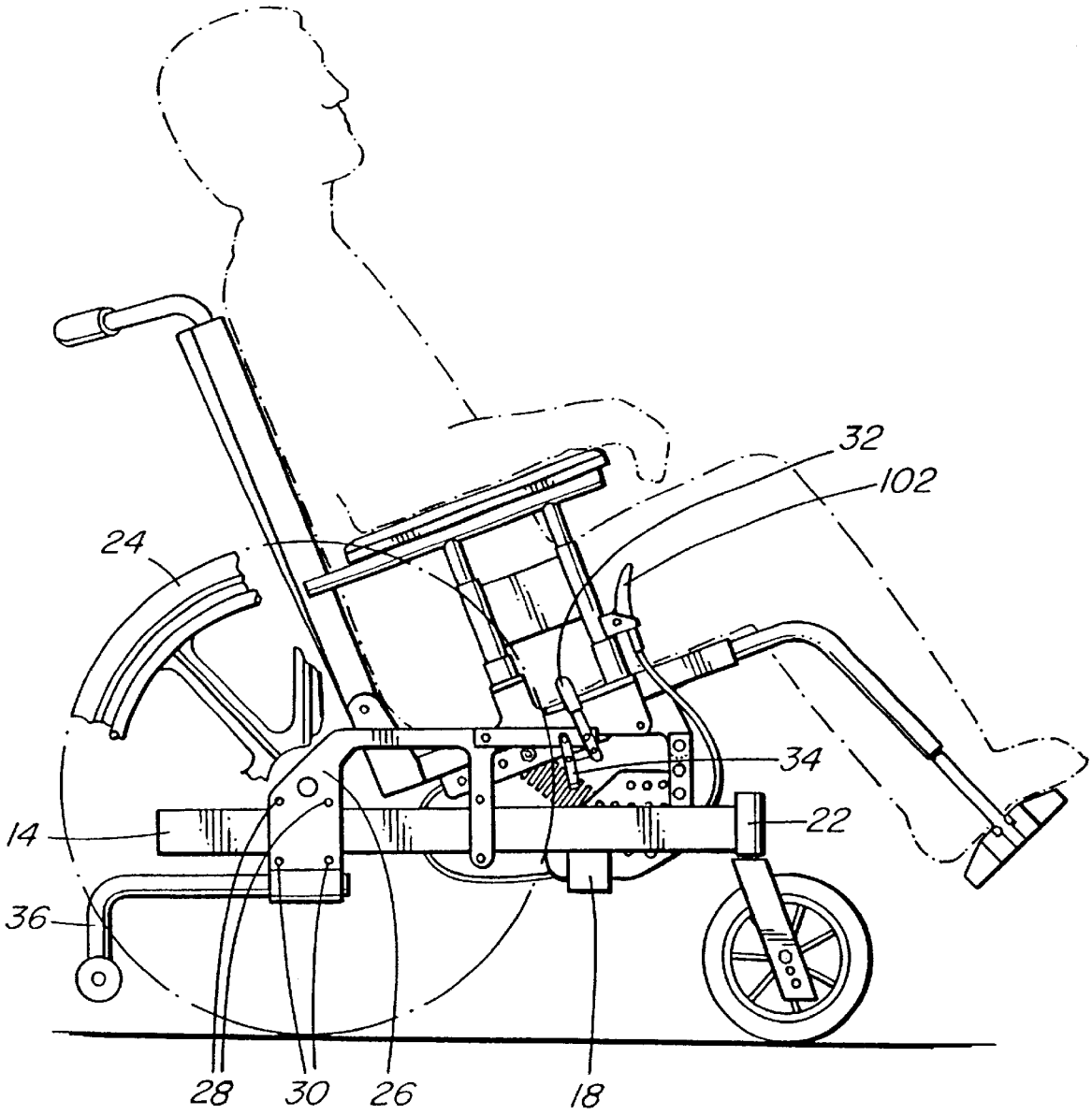
FIG. 3 is a side elevation of the wheelchair with the seat is a tilted position.

It will be appreciated by reference to FIGS. 1, 2 and 3 that the position of the tilt fulcrum according to the invention allows the rider to tilt back without significantly elevating the rider's knees, particularly as compared to when the tilt fulcrum is located near the rider's hips as in the prior art.

It will also be appreciated that as the rider tilts back, the rearward movement of the rider's center of mass is negligible as compared to when the rider is tilted about the hips. As a result, there is less risk of tipping backwards and consequently there is no need to compensate for such risk by displacing the rear wheels farther back as in the prior art, thereby maintaining maneuverability in confined environments.

Figure 5:
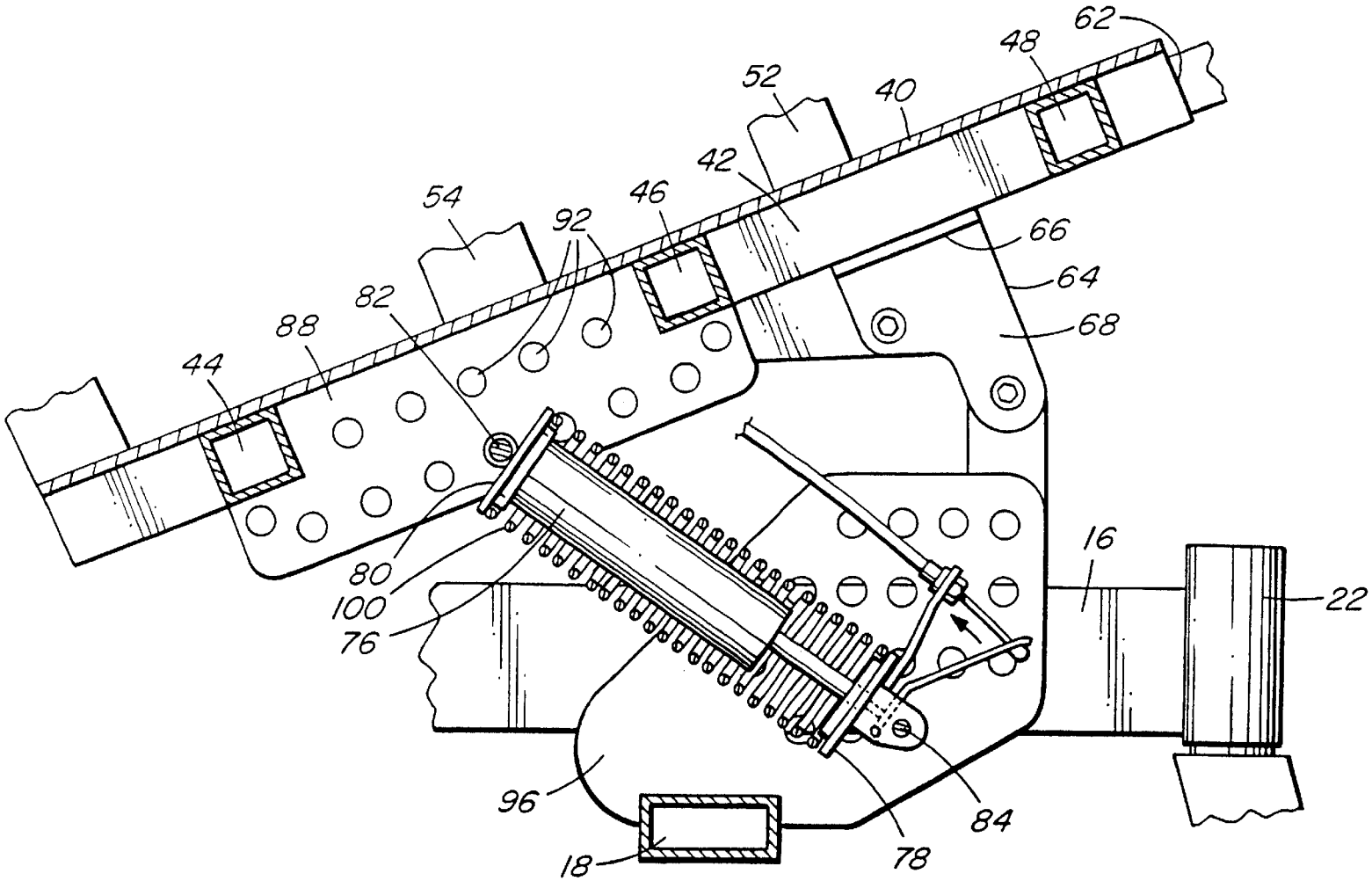

FIGS. 4 and 5 illustrate a lockable gas strut assembly according to the invention. Each end 78, 80 of the gas strut 76 terminates in means for receiving a long bolt 82, 84. Two parallel and spaced upper strut mounting brackets 86, 88 extend down from seat cross bars 44 and 46. Upper end 80 of the gas strut 76 is pivotally attached between the upper mounting brackets 86, 88 by threading long bolt 82 into selected mounting holes 92 provided throughout brackets 86, 88. Similarly, lower end 78 of the gas strut 76 is pivotally attached between two parallel and spaced the lower mounting brackets 94, 96 by threading long bolt 92 into selected mounting holes 98 provided throughout brackets 94, 96. Lower mounting brackets 94, 96 are rigidly mounted near the center of front cross bar 18.

The plurality of strut mounting holes 92, 98 provide adjustability in the mounting of the gas strut 76. By changing the position of the gas strut on the upper and lower mounting brackets, varying degrees of mechanical advantage can be achieved, thereby accommodating riders of different weight. Other means of selectively positioning the gas strut are also contemplated. For example, a horizontal slot with a plurality of downward dips could be provided to allow the end of the gas strut to be moved to different dip positions and thereby change the angle of the gas strut as between the seat assembly and the frame assembly. The gas strut could be locked into position in one of the dips by means of a removable cover plate.

Lockable gas strut 76 extends within a spring 100 which is in compression when the seat is tilted as shown in FIG. 5. Gas strut 76 is extended when in operation so as to bias the seat to a level position as shown in FIG. 4. Thus spring 100 and gas strut 76 both operate to bias the seat to a level position. The operation of gas strut 76 is controlled by a manual trigger 102 which when operated releases the gas strut locking mechanism and allows it to extend or retract. The rider's weight, possibly in addition to some manual force from the rider, is then able to compress spring 100 and cause the seat to tilt. Once in a tilted position, the trigger 102 may be used to reactivate the gas strut and to push the seat back to a level position, assisted by the bias of spring 100.

Ideally, the rider will ensure that gas strut 76 is mounted on the brackets 86, 88, 94, 96 so as to just allow the weight of the rider to compress spring 100 (without the need for the application of additional manual force) when the gas strut 76 is released.

It will be appreciated that the rider is thereby able to tilt the seat with a minimum of physical effort.

It will also be appreciated that the preferred embodiment of the invention has been described in some detail, but that variations thereto may be practised without departing from the broad scope of the invention.

What is claimed is:

1. A wheelchair comprising:

a frame;

a pair of main wheels mounted on opposite sides of said frame and a pair of caster wheels mounted forwardly of said main wheels on opposite sides of a front end of said frame;

a seat assembly comprising a seat pan and downwardly extending members at each side of said seat pan, said seat pan having a front edge and a top surface and being selectively tiltable to a plurality of set positions about a fulcrum; and, wherein said fulcrum is located between 3 and 7 inches rearward of the front edge of the seat pan and between 1 and 4 inches below the top surface of said seat pan.

2. A wheelchair as in claim 1 wherein said fulcrum comprises a pivoting connection on each side of said wheelchair between said members and said frame.

3. A wheelchair as in claim 2 wherein the seat assembly is supported on the frame only by said pivoting connections and by bias means extending from said frame to said seat assembly.

4. A wheelchair as in claim 3, wherein said bias means comprises a gas strut.

5. A wheelchair as in claim 3 wherein said bias means comprises a spring.

6. A wheelchair as in claim 3 wherein said bias means comprises a gas strut and a spring.

7. A wheelchair as in claim 4, 5 or 6 wherein said bias means extends from the center of a rigid straight transverse frame member to the bottom of said seat pan.

8. A wheelchair having a bias assembly wherein:

said wheelchair comprises a frame, a pair of main wheels mounted on opposite sides of said frame and pair of caster wheels mounted forwardly of said main wheels on opposite sides of a front end of said frame, a tiltable seat pan, a seat assembly supported on said frame and a rigid straight transverse frame member;

said bias assembly comprises a biasing element extending from said rigid straight transverse frame member to said seat assembly, said biasing element being selectively, adjustable to a plurality of bias set points; and said bias element is adjustably mounted between said frame and said seat assembly whereby to modify the mechanical advantage offered by said bias element, and wherein said adjustable mounting means is by means of at least one mounting bracket rigidly secured to said seat assembly and comprising a plurality of mounting holes, and at least one mounting bracket rigidly secured to said frame and comprising a plurality of mounting holes.

9. The wheelchair of claim 8 wherein said bias element extends from the center of said transverse frame member to said seat assembly.

10. A method for using a bias assembly to adjust a wheelchair, said wheelchair having a bias assembly comprising a tiltable seat pan, a seat assembly supported on a frame, a first and a second biasing elements extending from said frame to said seat assembly and exerting a bias force between said seat assembly and said frame, said first biasing element being controllable by a user of said wheelchair to selectively adjust the biasing force exerted by said first biasing element between said frame and said seat assembly, said use of a bias assembly comprising the step of mounting said bias assembly between selected mounting holes associated with said frame and selected mounting holes associated with said seat assembly such that the combined weight of the rider and the seat assembly will be just supported in a level position when both of said first and second biasing elements are providing biasing force.

* * * * *